US006260392B1

(12) United States Patent
Geiger

(10) Patent No.: US 6,260,392 B1
(45) Date of Patent: Jul. 17, 2001

(54) LOCK, ESPECIALLY FOR A LOCK INSTALLATION

(75) Inventor: Diethard Geiger, Velbert (DE)

(73) Assignee: Schulte-Schlagbaum Aktiengesellschaft, Velbert (DE)

( * ) Notice: Subject to any disclaimer, the term of this patent is extended or adjusted under 35 U.S.C. 154(b) by 0 days.

(21) Appl. No.: 09/352,535

(22) Filed: Jul. 13, 1999

(30) Foreign Application Priority Data

Jul. 20, 1998 (DE) ..... 198 32 516

(51) Int. Cl.[7] ..... E05B 47/00

(52) U.S. Cl. ..... 70/276; 70/278.1; 70/DIG. 41; 340/825.31

(58) Field of Search ..... 70/134, 276, 278.1, 70/278.2, DIG. 41; 340/825.31

(56) References Cited

U.S. PATENT DOCUMENTS 4,391,204 * 7/1983 Mitchell et al. ..... 70/DIG. 41 X
4,534,194 * 8/1985 Aydin ..... 70/278.2
4,572,348 * 2/1986 Eisermann et al. ..... 70/DIG. 41 X
4,739,638 * 4/1988 Lin ..... 70/134 X
4,817,404 * 4/1989 Eisermann et al. ..... 70/DIG. 41 X
4,918,957 * 4/1990 Eisermann ..... 70/DIG. 41 X
5,184,491 * 2/1993 Schittenhelm ..... 70/278.1
5,487,289 * 1/1996 Otto, III et al. ..... 70/276 X
5,541,581 * 7/1996 Trent ..... 70/278.2
5,548,984 * 8/1996 Miyatsu ..... 70/276
5,573,098 * 11/1996 Widmer ..... 70/DIG. 41 X
5,701,828 * 12/1997 Benore et al. ..... 70/278.2 X
5,718,135 * 2/1998 Bertenshaw et al. ..... 70/278.2
5,732,579 * 3/1998 D'Hont et al. ..... 70/278.2
5,735,152 * 4/1998 Dietz et al. ..... 70/276 X
5,749,253 * 5/1998 Glick et al. ..... 70/278.2
5,774,059 * 6/1998 Henry et al. ..... 70/276 X
5,823,026 * 10/1998 Finke ..... 70/276
5,841,361 * 11/1998 Hoffman ..... 70/278.1 X
5,878,612 * 3/1999 Mauer ..... 70/278.2
5,894,277 * 4/1999 Keskin et al. ..... 70/278.1 X
5,923,264 * 7/1999 Lavelle et al. ..... 70/278.1
6,032,499 * 3/2000 Juillerat et al. ..... 70/278.1 X
6,098,433 * 8/2000 Maniaci ..... 70/278.1

* cited by examiner

*Primary Examiner*—Suzanne Dino Barrett
(74) *Attorney, Agent, or Firm*—Martin A. Farber

(57) ABSTRACT

A lock, especially for a lock installation, having a housing (3) mounted inside a door (2) of a clothing locker or the like, the housing (3) being for a locking bolt (7) which is moveable by a rotary handle (14) projecting outwardly through the door (2), and, the occurrence, after activation of an electronic verification apparatus (21) and subsequent queries regarding the locking entitlement of a transponder (19), of electrical guidance applying to a locking-assist element (26) to release the locking actuation, whereby for activation in the rotary handle (14) which supports an antenna (18) for querying the transponder, there is provided a switch (20) which is sensitive to rotation and/or pressure.

14 Claims, 3 Drawing Sheets

LOCK, ESPECIALLY FOR A LOCK INSTALLATION

FIELD AND BACKGROUND OF THE INVENTION

The invention relates to a lock, in particular for a lock installation, having inside a door of a clothing locker or the like, a mounted housing for a bolt which is movable by a rotary handle extending outwardly through the door. Such locks have been known for many years on the market. With reference to the rotary handle this involves a key for a lock cylinder. Locking of the door of the locker is attained only by inserting a corresponding coin, with the door open, into a lock fastened to the inside of the door. After the door is closed, it is possible to close the locking bolt, using the key representing the rotary handle. The key representing the rotary handle can then be withdrawn, and accompanies the user while, for example, he uses a swimming facility.

SUMMARY OF THE INVENTION

The invention has, as its object, a lock of the kind mentioned, which is more user-friendly and secure.

This object is attained essentially by a lock with the characteristics of claim 1, further involving the provision, after activation of an electronic verification apparatus and subsequent queries regarding the locking entitlement of a transponder, of electrical control of a locking-assist element, to release the locking activation, wherein, in order to activate the rotary handle which supports an antenna for querying the transponder, there is provided a switch sensitive to rotation and/or pressure.

The result of this configuration is a lock of the kind mentioned, having improved serviceability. It is no longer necessary to have a key to lock and unlock the bolt. Also unnecessary is a keyway of a locking cylinder accessible from the outside of the door, which can be taken out of operation by forcing instant glue or objects into the opening. The lock includes an electronic verification apparatus. The latter is accommodated in the rotary handle, and is activated by a switch sensitive to rotation and/or pressure, so that a transponder cooperating with the handle, using an antenna incorporated into the rotary handle, can be checked for locking entitlement. If this is confirmed, the result is an electrical guiding of the locking-assist element, thus releasing the locking action. For example, transponders and electronic verification apparatus can cooperate in such a way that each lock and each transponder constituting a unique closure element carries a locking-identity code storage and/or a key code storage, and each individual lock is closeable only by way of such individual closure elements or transponders, and only if the lock identity code and/or key code correspond with one another. The key-code storage of the lock and/or the lock-identity code storage of the transponder are storage facilities which can be erased and overwritten, such that, during a first activation of the lock-identity code of the lock in the lock identity code storage of the individual lock element, and/or the key code of the individual lock element in the key code storage of the lock, are entered. Consequently, the lock can be unbolted only by using that transponder which was utilized for the closing of the lock. Preferably it can be arranged that the key-code storage of the lock is erased at the time of the second use. By this means, the lock is always in a ready condition, so that a subsequent visitor with a different transponder can lock the lock and utilize the locker. However, it can also be provided that each transponder cooperates with an individual lock of the lock installation. In this case, the transponder and the corresponding lock carry the same number. To attained the inventive objective, it can also occur that the locking-assist element guides a bolt keeper from a position blocking the return movement of the bolt into a release position. In this situation the locking-assist element can be shifted by an electromagnet from a first position in which locking of the door is not possible, to a second position where the locking of the door can be carried out. In detail it appears that the guidance results from a dead-centre movement of a transfer spring. Further it is provided that the bolt is closeable against the spring force of a return spring. This makes easier the withdrawal of the bolt after the previous querying of the transponder regarding its locking entitlement. Positive movement of the bolt by the rotary handle is accomplished in a simple way by coupling the rotary handle to the bolt using a crank pin. In detail the bolt is held as a result of a dead-centre position of the crank pin. Reverse forces on the bolt are passed to the key housing, through the crank pin, such that high reverse forces can be accommodated without damage. Defined end positions of the locking-assist element are produced in that the bolt, with the locking-assist element in the second position, is held in locking position by the snapping-in of the holder element with respect to an abutment-offset in the bolt. This occurs due to the transfer spring extending beyond the dead-centre position. It can be anticipated that the armature of the electromagnet is held in each of its end positions as a result of the dead-centre positioning of the transfer spring. As an alternative, the electromagnet can be a permanent magnet, which in the first position is supported by permanent magnetic flux, and in the other position is held by an armature compression spring. Consequently, the electromagnet requires energy only when the armature is being moved in the first or second directions, such that a built-in energy storage in the form of batteries will have a long life. In order to reverse the lock left to right, the bolt itself is reversed. To achieve this, a blocking projection extending into the abutment-offset is located in the middle of the lock. Finally, an advantageous characteristic involves the provision, in the rotary handle, of multi-coloured light emitting diodes for the purpose of indicating status during transponder activation. If the green LED comes on, this indicates that the lock is bolted or unbolted in the ordinary way. The colour red indicates a problem, for example if there is an attempt to use the lock with a false transponder. A mixture of colours for the LED can be used to indicate that the batteries are no longer sufficiently charged, thus indicating that the batteries should be changed.

BRIEF DESCRIPTION OF THE DRAWINGS

With the above and other objects and other advantages in view, the present invention will become more clearly understood in connection with the detailed description of a preferred embodiment, when considered with the accompanying drawings of which.

DETAILED DESCRIPTION OF THE PREFERRED EMBODIMENT

Figure 2:
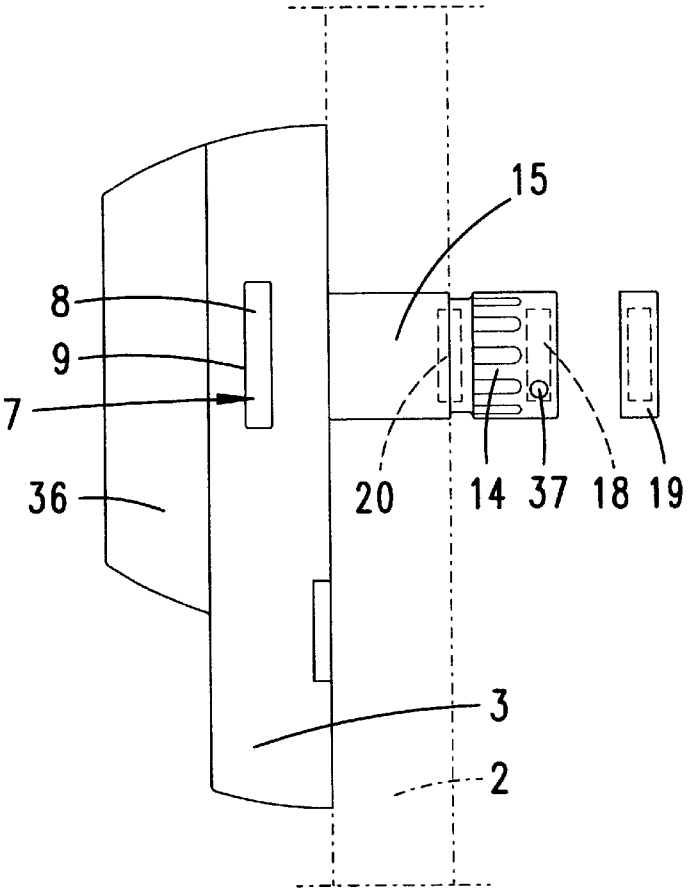
FIG. 2 is a simplified representation of FIG. 1.

The lock shown generally at the numeral 1 is a component of a lock installation which is not illustrated, for example in a public swimming pool. In such installations, the doors of the clothing lockers are provided with this kind of lock. Each lock 1 is secured to the inner surface of a locker door 2 illustrated in broken lines. Specifically, the lock 1 has a box-like lock housing 3. A lock cover, not illustrated, encloses the lock mechanism. From the base 4 of the lock housing 3 there extends a guide pin 5 which passes through an elongate slot 6 in a bolt 7. The bolt head 8 extends through a bolt aperture 9 in a side wall of the lock housing 3. The aforementioned longitudinal slot 6 is located in the bolt tail 10. The latter supports a projection 11 to which is connected one end of a return spring 12 configured as a tension spring. The other end of the spring is secured to a peg 13. By this means, the bolt 7 is continuously biased toward the unlocked condition.

The locking of the bolt 7 is accomplished by a rotary handle 14, for which there is provided a bearing sleeve 15 secured to the unseen lock cover. The bearing sleeve extends through a bore in the locker door 2. The rotary handle 14 is operatively connected to a crank pin 16, which projects through a transverse slot 17 which is perpendicular to the displacement direction of the bolt 7. Thus, by rotating the handle 14, the bolt 7 can be closed due to the crank pin 16 being in registry with the transverse slot 17, against the urging of the return spring 12.

The handle 14 incorporates a schematically illustrated antenna 18 for verifying the legitimacy of a transponder 19. The transponder 19 may have the shape of a coin. As an example, the transponder 19 can be provided in an arm band, in order to keep the transponder 19 on the body during a visit to a public swimming pool.

Alternatively it is possible to make the transponder 19 in the shape of a card-like locking element, instead of a coin. Here again it is possible to keep the card-like locking element on one's person utilizing an arm band. Further, it is possible to integrate the transponder into a watch that has an arm band, thus providing an element with multiple functions.

Figure 1:
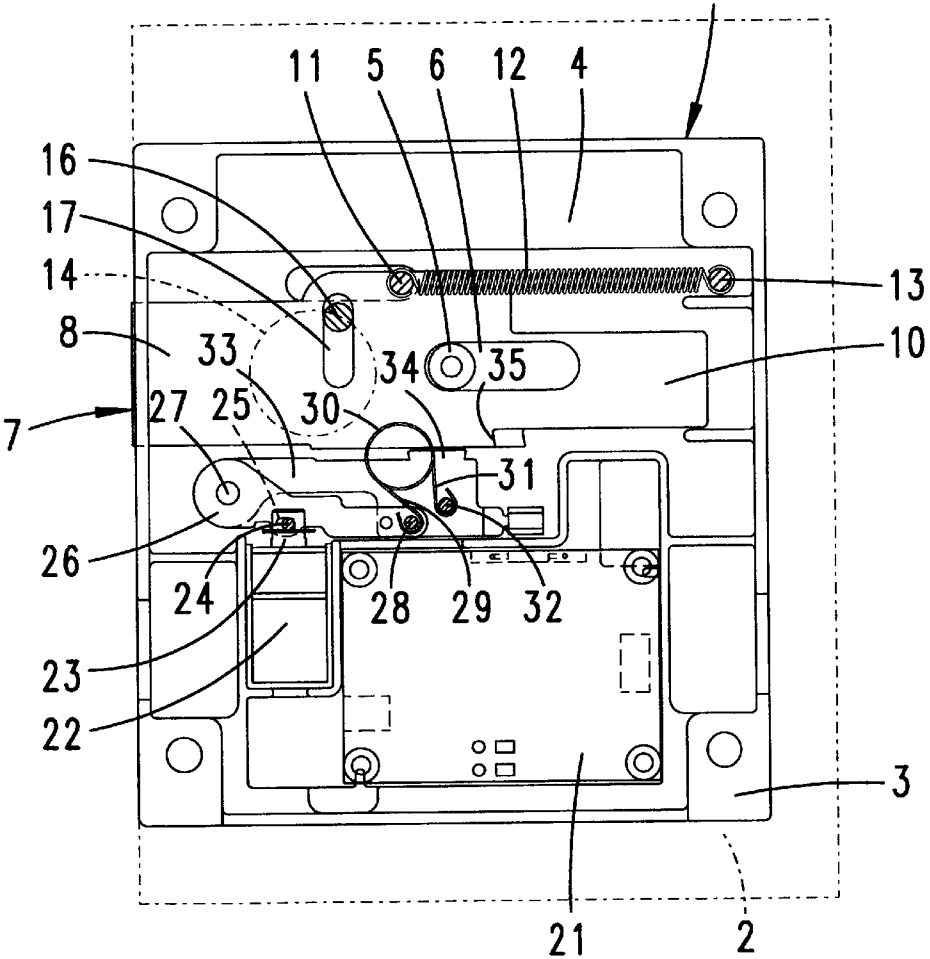
FIG. 1 is an internal elevation of a lock secured to the inside of a locker door, with the bolt withdrawn.
Figure 3:
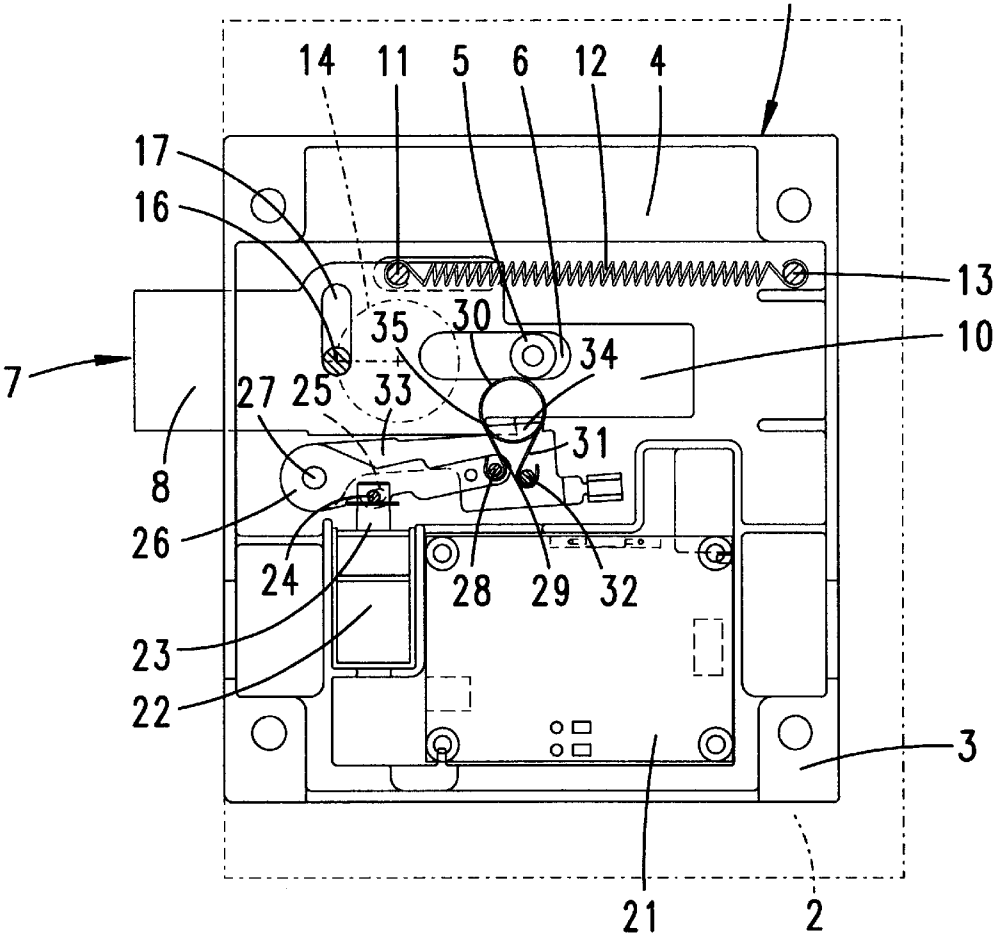
FIG. 3 is an illustration corresponding to FIG. 1, however the bolt has been closed and blocked.
Figure 4:
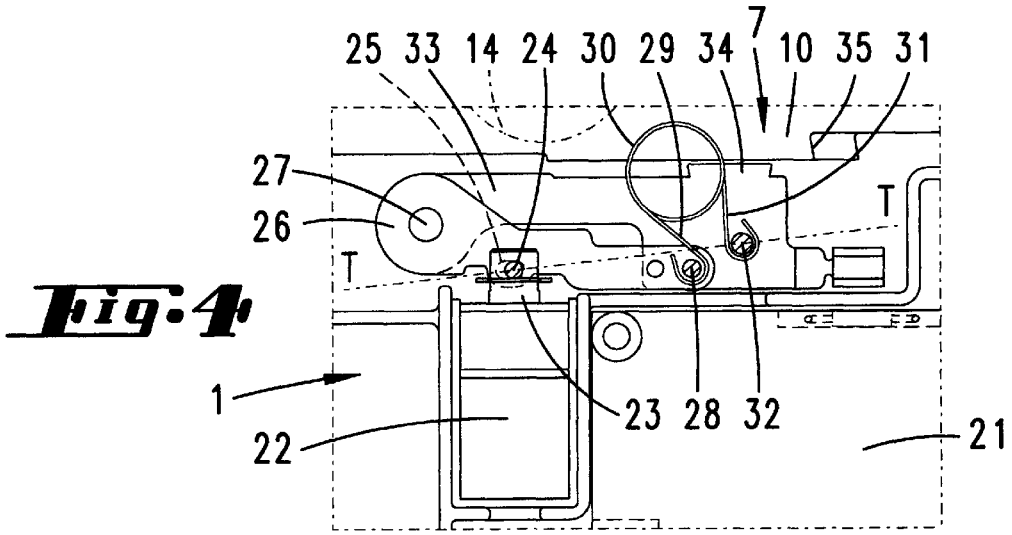
FIG. 4 shows, to a larger scale, a section in the region of a locking-assist member, corresponding to the release position of the bolt.

Internally, the handle 14 incorporates a rotation-sensitive or pressure-sensitive switch 20, which, after the corresponding movement, activates an electronic verification device located under the bolt 7 in the lock housing 3. The verification device is in electrical communication with an electromagnet 22, likewise located below the bolt 7, having a rod-like armature 23 capable of forward and reverse motion. A transverse peg 24 at the forward end of the armature 23 extends through a slot 25 of a one-arm lock-assist element 26, the slot 25 extending transversely to the movement direction of the armature 23. The locking-assist element 26 is mounted adjacent one end to a pivot pin 27, located on the side of the lock housing. The free end of the locking-assist element 26 is fitted with a support pin 28, around which is secured one end 29 of a transfer spring 30 configured as a torsion spring. The other end 31 of the transfer spring 30 surrounds a support pin 32 on a likewise one-arm configured holder element 33. The latter also is mounted about the pivot pin 27. On its upper edge, directed toward the bolt 7, the holder element 33 has a blocking projection 34 for cooperation with an abutment offset 35 on the bolt 7. When the armature 23 moves outwardly, the locking-assist element 26 moves with it. By virtue of the transfer spring 30, the holder element 33 moves in the downward direction and is maintained in a condition of abutment, in which the blocking projection 34 lies beyond the displacement path of the offset 35 of the bolt 7; compare FIGS. 1 and 4.

The electronic verification device 21 as well as the electromagnet 22 are fed from non-illustrated batteries in a battery chamber 36 extending outside the base 4.

It is even possible, without the use of a transponder 19, to use the handle 14 and crank pin 16 to close the bolt 7, even against the force of the return spring 12. In the locked condition, the crank pin 16 reaches a dead-centre condition, looking in the closure direction of the bolt. However, in this situation the bolt is not secured by the holder element 33. One of the variously coloured light diodes 37 incorporated into the rotary handle 14 can then be activated in the colour red in order to signal incorrect activation of the lock.

Figure 5:
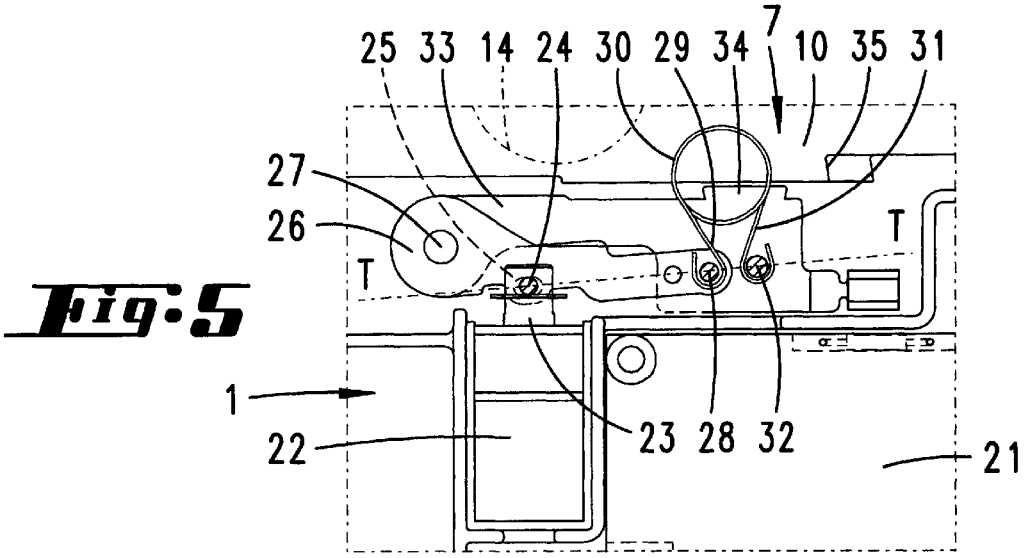
FIG. 5 is an illustration like that in FIG. 4, wherein, due to movement of the armature, the transfer spring is in the dead-centre position.
Figure 6:
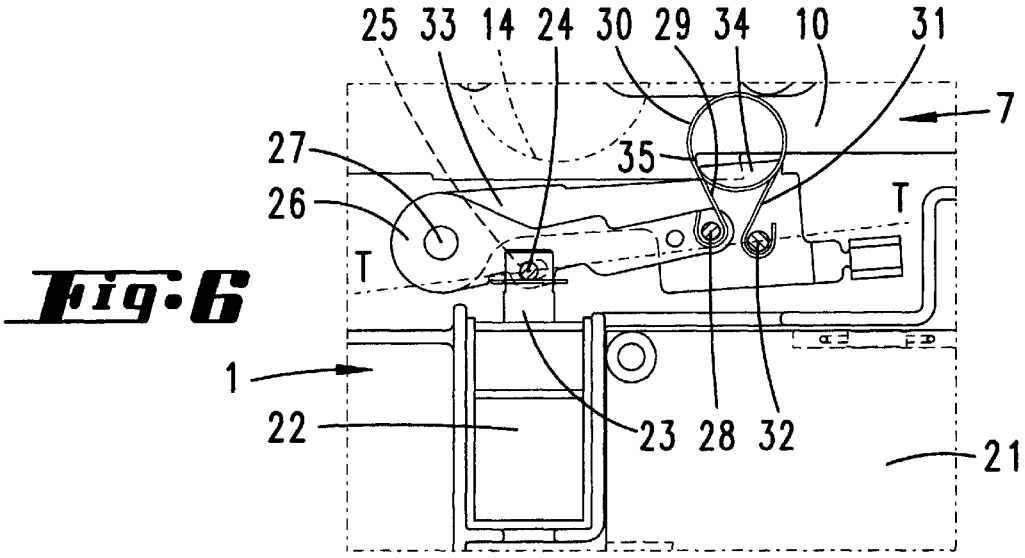
FIG. 6 is a section similar to FIG. 4, showing the locked position.

The locking of a previously occupied clothing locker therefore requires activation of the electronic verification apparatus 21 by way of the switch 20 provided for the rotary handle 14. This occurs during the rotation of, and/or pressure on, the rotary handle 14. Next, the transponder 19 for the rotary handle 14 undergoes verification using the antenna 18. If verification occurs, electrical power is fed to the electromagnet 22, which draws the armature 23 inwardly and entrains the locking assist element 26 in the clockwise direction. By this process, the transfer spring 30 reaches the dead-centre position as illustrated in FIG. 5, identified by the dead-centre line T—T. In the latter, the ends 29,31 of the transfer spring 30 are at the smallest spacing from one another. Once the apparatus goes beyond the dead-centre line T—T, the transfer spring 30 loads the holder element 33 in the counterclockwise sense, such that the blocking projection 34 moves up to contact the underside of the bolt tail 10. If the bolt 7 is closed by way of the rotary handle 14 and the crank pin 16, the holder element 33 will snap to the end phase of the bolt displacement in the region of the abutment offset 35, and will block return displacement of the bolt. When such proper closure of the bolt takes place, the light diode indicates the status with the colour green.

Without the proper transponder 19, it is not possible to properly close the key-bolt 7. The transponder 19 contains in its memory (not illustrated) the locking identity code of the particular lock, whereas the memory of the electronic verification device 21 contains the locking code of the transponder 19. If another transponder is used, the lock 1 will not open. Also, no other lock in the lock installation can be manipulated by the transponder which has the identity code of a given lock.

The release of the bolt 7 requires, as with the locking procedure, use of the appropriate transponder 19. The latter is laid against the end face of the rotary handle 14, while pressure is exerted on the rotary handle, which results in activation of the verification device 21. After lock-entitlement is recognized for the transponder 19, electric power is fed to the electromagnet 22, of which the armature 23 moves in the upward direction, thus moving the locking-assist element 26. By virtue of the transfer spring 30, which goes beyond the dead-centre position, the holder element 33 is shifted out of its blocking position with respect to the bolt 7, such that by rotating the rotary handle, the crank pin 16 can cause withdrawal of the key-bolt 7, this being furthered by the return spring 12.

If the LEDs light up as mixed colours, an indication is given to monitoring personnel that the batteries of certain locks are insufficiently charged. It is then necessary to replace the used batteries with new batteries.

With regard to the electromagnet 22, this is a self-recharging magnet, which is sustained in the locked condition by a permanent magnetic force, and in the other condition (open or unlocked) is sustained by an armature compression spring. Electrical energy is thus only necessary for a change in the armature position, thus leading to long battery life.

What is claimed is:

1. A lock for a lock installation, having a housing mounted inside a door of a locker and the like, a locking bolt in the housing, a rotary handle projecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, a switch sensitive to rotation and/or pressure for said activation, operatively connected to said handle, an antenna mounted in said rotary handle communicatable with the transponder and operatively connected to said electronic verification apparatus, further comprising a transfer spring operatively connected to the locking-assist element, and wherein control of the locking-assist element is achieved through a dead-centre displacement of said transfer spring.

2. A lock for a lock installation, having a housing mounted inside a door of a locker and the like, a locking bolt in the housing, a rotary handle protecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, a switch sensitive to rotation and/or pressure for said activation, operatively connected to said handle, an antenna mounted in said rotary handle communicatable with the transponder and operatively connected to said electronic verification apparatus, further comprising a return spring operatively connected to said bolt, and wherein the bolt is closeable against spring force of said return spring.

3. A lock for a lock installation, having a housing mounted inside a door of a locker and the like, a locking bolt in the housing, a rotary handle protecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, a switch sensitive to rotation and/or pressure for said activation, operatively connected to said handle, an antenna mounted in said rotary handle communicatable with the transponder and operatively connected to said electronic verification apparatus, further comprising a crank pin operatively connected to said bolt and said rotary handle, and wherein the rotary handle is coupled with the bolt through said crank pin.

4. A lock according to claim 3, wherein the bolt is held in a closed position by a dead-centre position of the crank pin.

5. A lock according to claim 4, further comprising a holder element operatively connected to said locking-assist element, wherein the bolt is held in a closed position by the locking-assist element brought into a position wherein the holder element snaps into place in an abutment-offset in the bolt.

6. A lock for a lock installation, having a housing mounted inside a door of a locker and the like, a locking bolt in the housing, a rotary handle protecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, a switch sensitive to rotation and/or pressure for said activation, operatively connected to said handle, an antenna mounted in said rotary handle communicatable with the transponder and operatively connected to said electronic verification apparatus, an electromagnet operatively connected to said locking-assist element wherein the locking-assist element is movable by said electromagnet from a first position in which there is no locking of the lock to a second position in which locking of the lock is enabled, a transfer spring connected to said locking-assist element, and wherein an armature of the electromagnet is retained in each of two end positions thereof by a dead-centre condition of said transfer spring.

7. A lock for a lock installation, having a housing mounted inside a door of a locker and the like, a locking bolt in the housing, a rotary handle protecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, a switch sensitive to rotation and/or pressure for said activation, operatively connected to said handle, an antenna mounted in said rotary handle communicatable with the transponder and operatively connected to said electronic verification apparatus, wherein a blocking projection of a holder element extendable into an abutment-offset of the bolt lies centrally of the lock, the holder element being operatively connected to said locking-assist element.

8. A lock for a lock installation, having a housing mounted inside a door of a locker and the like, a locking bolt in the housing, a rotary handle protecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, and a holder element operatively connected to the locking-assist element, and wherein the locking-assist element guides said holder element from a position blocking a return movement of the locking bolt to a release position, further comprising a transfer spring operatively connected to the locking-assist element and to said holder element, and wherein control of the locking-assist element is achieved through a dead-centre displacement of said transfer spring.

9. A lock for a lock installation, having a housing mounted inside a door of a locker and the like, a locking bolt in the housing, a rotary handle projecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, and a holder element operatively connected to the locking-assist element, and wherein the locking-assist element guides said holder element from a position blocking a return movement of the locking bolt to a release position, further comprising a return spring operatively to said bolt, and wherein the bolt is closeable against spring force of said return spring.

10. A lock for a lock installation, having a housing mounted inside a door of a locker and the like, a locking bolt in the housing, a rotary handle projecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, and a holder element operatively connected to the locking-assist element, and wherein the locking-assist element guides said holder element from a position blocking a return movement of the locking bolt to a release position, further comprising a crank pin operatively connected to said bolt and said rotary handle, and wherein the rotary handle is coupled with the bolt through said crank pin.

11. A lock according to claim 10, wherein the bolt is held in a closed position by a dead-centre position of the crank pin.

12. A lock according to claim 11, wherein the bolt is held in a closed position by the locking-assist element brought into a position wherein the holder element snaps into place in an abutment-offset in the bolt.

13. A lock for a lock installation, having a housing mounted inside a door of a locker and the like, a locking bolt in the housing, a rotary handle projecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, and a holder element operatively connected to the locking-assist element, and wherein the locking-assist element guides said holder element from a position blocking a return movement of the locking bolt to a release position, an electromagnet operatively connected to said locking-assist element wherein the locking-assist element is movable by said electromagnet from a first position in which there is no locking of the lock to a second position in which locking of the lock is enabled, a transfer spring connected to said locking-assist element and to said holder element, and wherein an armature of the electromagnet is retained in each of two end positions thereof by a dead-centre condition of said transfer spring.

14. A lock for a lock installation, having a housing mounted inside a door of a locker and the like, a locking bolt in the housing, a rotary handle protecting outwardly through the door for moving the locking bolt, an electronic verification apparatus after activation thereof for interrogating a transponder for locking entitlement, an electrically controllable locking-assist element operatively connected to said electronic verification apparatus for releasing locking actuation of the lock, and a holder element operatively connected to the locking-assist element, and wherein the locking-assist element guides said holder element from a position blocking a return movement of the locking bolt to a release position, wherein a blocking projection of the holder element extendable into an abutment-offset of the bolt lies centrally of the lock.

* * * * *